United States Patent [19]

Knapp et al.

[11] 4,395,988

[45] Aug. 2, 1983

[54] FUEL INJECTION SYSTEM

[75] Inventors: Heinrich Knapp, Leonberg; Mathias Linssen, Scheblitz; Jürgen Peczkowski, Inbert-Oberwürzbach; Waldemar Hans, Bamberg, all of Fed. Rep. of Germany

[73] Assignee: Robert Bosch GmbH, Stuttgart, Fed. Rep. of Germany

[21] Appl. No.: 245,821

[22] Filed: Mar. 20, 1981

[30] Foreign Application Priority Data

Mar. 20, 1980 [DE] Fed. Rep. of Germany ..... 3010613

[51] Int. Cl.[3] ..... F02P 5/00

[52] U.S. Cl. ..... 123/469; 239/125; 239/585; 123/511

[58] Field of Search ..... 123/468–470, 123/511; 239/125, 575, 585, 590, 590.3

[56] References Cited

U.S. PATENT DOCUMENTS 3,776,209 12/1973 Wertheimer et al. ..... 123/470

FOREIGN PATENT DOCUMENTS 478331 2/1953 Italy ..... 123/511

187387 10/1922 United Kingdom ..... 239/125

*Primary Examiner*—Craig R. Feinberg

*Attorney, Agent, or Firm*—Edwin E. Greigg

[57] ABSTRACT

A fuel injection system for internal combustion engines having a multiplicity of injection valves which serves to provide fuel supply is proposed. The fuel injection system includes a common, rigid fuel line, having plug nipples into which the injection valves associated with the individual cylinders of the engine can be inserted in a sealing manner. The fuel line comprises one fuel distributor line and one fuel return flow line located one above the other. Each injection valve has one inlet stub and one outlet stub disposed concentrically relative to one another, protruding into the plug nipple in such a manner that the inflow stub communicates with the fuel distributor line and the outflow stub communicates with the fuel return flow line. As a result, not only is it possible to provide simple sealing toward the outside between the injection valve and the plug nipple but also rapid assembly of the fuel injection system is assured.

7 Claims, 5 Drawing Figures

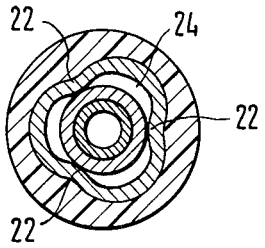
FIG. 2
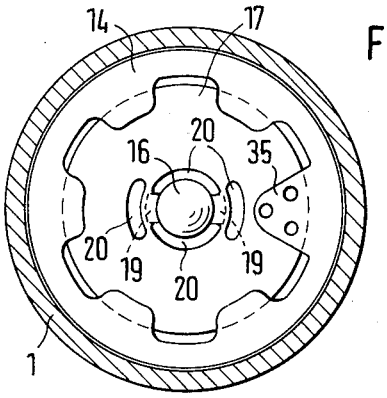
FIG. 3
FIG. 4
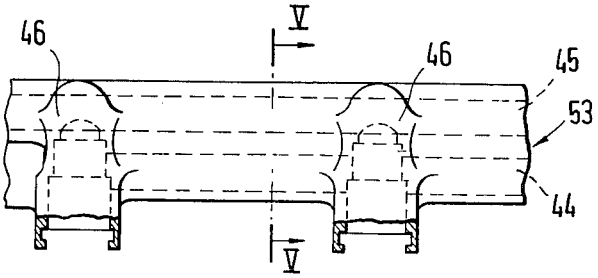
FIG. 5
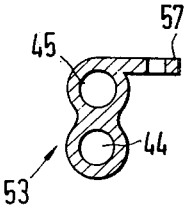

FUEL INJECTION SYSTEM

BACKGROUND OF THE INVENTION

The invention is based on a fuel injection system of a general type described hereinafter. A fuel injection system having an electromagnetically actuable valve is already known, the valve having a feed line to a supply line having fuel flowing through it, with a return flow line being disposed in the feed line by way of which excess fuel can flow back to the supply line. However, this apparatus has the disadvantage that the fuel which has been warmed in the injection valve and may now contain vapor bubbles is delivered to the next subsequent injection valve and there causes unsatisfactory fuel injection, which may be expensive when the engine comes to a stop.

OBJECT AND SUMMARY OF THE INVENTION

The valve according to the invention having the characteristics described hereinafter has the advantage over the prior art that while the injection valve on the fuel line has a concentric structure which saves as much space as possible, it is assured that fuel which has been heated and contains vapor bubbles is no longer used for the immediate supply of further injection valves. Furthermore, the injection valves inserted into the fuel line can be simultaneously inserted and mounted in the engine together with the fuel line, as a separately manipulable, testable and mountable element.

As a result of the characteristics disclosed in the dependent claims, advantageous modifications of and/or improvements to the fuel injection system disclosed in the main claim can be attained.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 2 is a section taken along the line II—II of FIG. 1;

FIG. 3 is a section taken along the line III—III of FIG. 1;

FIG. 4 shows a fuel line; and

FIG. 5 is a section taken along the line V—V of FIG. 4.

DESCRIPTION OF THE PREFERRED EMBODIMENT

Figure 1:
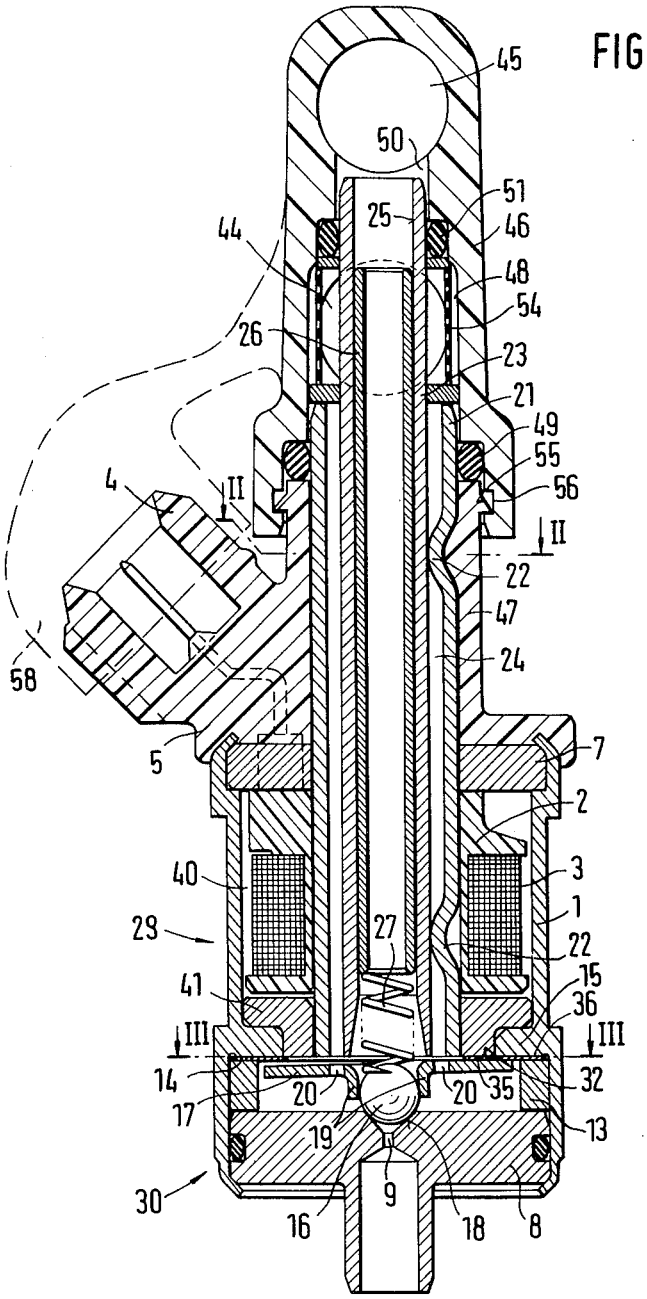
FIG. 1 shows a fuel injection valve in cross-section together with a fuel feed line.

The fuel injection valve for a fuel injection system shown in FIG. 1 serves the purpose of injecting fuel, particularly at relatively low pressure, into the intake tube of mixture-compressing internal combustion engines having externally-supplied ignition. A magnetic coil 3 is disposed on a coil carrier inside a valve housing 1. The magnetic coil 3 has a means of electrical current supply provided by an electrical plug terminal 4, which is embedded in a plastic ring element 5 seated axially upon the valve housing 1. A closure plate 7 is inlaid in the end of the valve housing 1 oriented toward the electrical plug terminal 4, sealing the valve housing at this end by flanging and welding or soldering. On the end of the fuel injection valve remote from the electrical plug terminal 4, a nozzle carrier 8 is flanged in a sealing manner together with the valve housing unit 1 and has a nozzle 9 disposed within it.

A stroke ring 13 may be placed upon the nozzle carrier 8 and a remnant air disc 14 can be placed on the stroke ring 13. This remnant air disc 14 is held firmly in place as a result of the pressure force resulting from the flanging of the valve housing 1 onto the nozzle carrier 8. The stroke ring 13 may also be embodied directly on the nozzle carrier 8. The remnant air disc 14, made of non-magnetic spring material, for instance a cobalt-nickel-chrome alloy, extends at least partially radially over a step 15 of the valve housing 1 remote from the electrical plug terminal 4, and prevents magnetic adhesion of the flat armature 17 to the step 15. The flat armature 17 is embodied in disc-like form and is made in particular of sheet metal. A ball 16, which is firmly connected with tongues 19 of the flat armature 17 and cooperates with a fixed valve seat 18 in the nozzle carrier 8 which extends conically toward the nozzle 9, constitutes together with the flat armature 17 the removable valve element. Flow-through openings 20 are provided in the flat armature 17. The supply of fuel, for instance gasoline, is effected by way of a tubular inflow stub 21 disposed concentrically to the valve axis, which simultaneously acts as the core and on which the coil carrier 2 is disposed. The inlet stub 21 is provided with inwardly directed protrusions 22 (see FIG. 2 as well) formed by means of squeezing, which are displaced from one another by 120 degrees and, extending in a second axial plan, concentrically guide a tubular discharge stub 23 which protrudes almost up to the flat armature 17 and which forms a flow cross section 24 for the inflowing fuel between its outer circumference and the minimum diameter of the inlet stub 21. A tube insert 26 is inserted in the lower stub 25 of the discharge stub 23, and a closing spring 27 is supported on the tube insert 26 on one end and the other end rests on the ball 16, pressing the ball 16 against the valve seat 18 of the nozzle carrier 8 closing the valve, in the non-excited state of the magnetic element 3, 15. The fuel flowing into the fuel injection valve via the flow cross section 24 proceeds over the flow-through openings 20 and the flat armature 17 to the actual valve, made up of the valve seat 8, 18 with fuel which has not been injected and vapor bubbles being capable of flowing out from there once again by way of the discharge stub 23.

The valve housing 1 encloses the magnetic element 29 and the valve element 30, acting as a common housing for both.

A spring tongue 35 has been cut out of the remnant air disc 14 shown in FIG. 3, as well, the spring tongue 35 being secured on the flat armature 17 on the end protruding out of the spring tongue holder means 36 on the valve housing 1, on the side 32 of the flat armature 17 remote from the fixed valve seat 18; this fastening is effected by means of welding or soldering, for example. The flat armature 17 can thus execute a pivotal motion about the spring tongue holder means 36 on the housing 1. The spring tongue 35 must not necessarily be shaped from the substance of the remnant air disc 14; instead, it may also be embodied as a separate element from spring steel, and may be held attached to the housing. As a result of the unilateral fixation of the flat armature 17 by the spring tongue 35, it is assured that the flat armature 17 will only make a pivotal motion about the spring tongue holder means 36.

In the excited state, the flat armature 17 is attracted by the magnetic coil 3 and the ball 16 opens the valve seat 18 by way of which fuel can flow into the nozzle 9, which performs throttling and meters the fuel, and can be injected by way of an ejection port 39 which widens in a conical form adjacent thereto.

The magnetic coil chamber 40 is sealed off by a ring 41 of non-magnetic material from the fuel, being soldered at its circumference first with the inlet stub 21 and then with the step 15 of the valve housing. The embodiment of the fuel injection valve makes it possible for fuel, which is continually arriving by way of the inlet stub 21 or the flow cross section 24 from a fuel distributor line 44, to be carried past the valve seat 18 and flow via the discharge stub 23 into a fuel return flow line 45, so that any vapor bubbles which may have been formed as a result of the heating of the fuel are carried along with the fuel to the fuel return flow line 45, while on the other hand, a continuous cooling of the fuel injection valve by the flowing fuel is assured.

The fuel connection of the fuel connection valve is affected by way of plug nipple 46, which surrounds the fuel distributor line 44 and the fuel return flow line 45 above that, and is inserted on a ring step 47 of the plastic ring element 5. The inlet stub 21 protrudes partially into a bore 48 of the plug nipple 46, which is in communication with the fuel distributor line 44, so that fuel can flow into the valve by way of the flow cross section 24. The fuel side 44, 45 is sealed off from the atmosphere by an O-ring 49, which is disposed in the plug nipple 46 and surroundingly engages the inlet stub 21. A plurality of O-rings may also be provided. The discharge stub 23 protrudes into a bore 50 of the plug nipple 46, which communicates with the fuel return flow line 45 and has a smaller diameter than the bore 48. An O-ring 51 efects sealing within the plug nipple 46 between the fuel distributor line 44 and the fuel return flow line 45, but because of the low pressure drop this O-ring may also be omitted. The same scavenging and cooling affect is naturally also attained in the fuel distributor line and the fuel return flow line are exchanged for one another, so that fuel flows in by way of the bore 25 of the stub 23 and flow out by way of the flow cross section 24.

The fuel injection valve is part of a fuel injection system having a multiplicity of injection valves, each of which is connected in a sealing fashion at one end with the plug nipple 46, and can be inserted in a manner not shown with its other end into an appropriate opening of an intake tube of one of the cylinders of the engine in a sealing manner. As also shown in FIGS. 4 and 5, the plug nipple 46 is part of a rigid fuel line 53, in which the fuel distributor line 44, supplied with fuel from a fuel supply pump, not shown, and the fuel return flow line 45 leading back to the intake side of the fuel supply pump are disposed one above another. The inlet stub 21 and the discharge stub 23 of the injection valve each protrude into the plug nipple 44 to such an extent that inlet stub 21 communicates with the fuel distributor line 44 and the discharge stub 23 communicates with the fuel return flow line 45. A fuel filter 54, embodied in cylindrical form is disposed in the bore 48 of the plug nipple 46, surroundingly engaging the discharge stub 23 passing therethrough in such a way that the fuel flowing in from the fuel distributor line 44 can flow into the flow cross section 24 only by way of the fuel filter 54. The upper O-ring 51 is supported on the fuel filter 54. Protrusions 55 are molded on the ring step 47 of the plastic ring element 55, and these protrusions come to rest in a corresponding groove 56 of the plug nipple 46 when the injection valve is inserted into the plug nipple 46. The fuel line 53 (see FIGS. 4 and 5) is advantageously embodied as a spray-molded or pressure-cast element and is held on the engine by fastening means not shown in detail, for instance tongues 57 which are molded on the fuel line 53. As is indicated by broken lines, it is possible to provide one electric plug 58 on the fuel line 53 in the vicinity of each plug nipple 46, by way of which the electrical connection to the electric plug terminal 4 of the injection valve can simultaneously be established when the injection valve is inserted into the plug nipple 46.

The foregoing relates to a preferred exemplary embodiment of the invention, it being understood that other embodiments and varients thereof are possible within the spirit and scope of the invention, the latter being defined by the appended claims.

What is claimed and desired to be secured by Letters Patent of the United States is:

1. A fuel injection system for internal combustion engines having a multiplicity of injection valves and a corresponding number of cylinders, each of said injection valves connected on one end in a sealing manner with a plug nipple forming a part of a rigid fuel line and having another end which is insertable in a sealing manner into an appropriate opening in an intake tube of one of the cylinders of said engine, a common fuel distributor line and a common fuel return flow line included in said rigid fuel line, each said injection valves having concentrically disposed inlet and outlet stubs arranged to protrude into said respective plug nipple, said inlet stub communicates with said fuel distributor line and said outlet stub communicates with said fuel return flow line, wherein each said plug nipple is provided with a fuel filter, said fuel filter being disposed between said fuel distributor line and said inlet stub, at least one elastic sealing ring is disposed in said plug nipple surrounding an inner one of said two stubs and thereby sealing off said fuel distributor line and said fuel return flow line from one another, and said elastic sealing ring is supported on said fuel filter.

2. A fuel injection system as defined by claim 1, wherein said plug nipple further includes sealing means which surrounds at least one of said stubs to thereby form a seal to atmosphere.

3. A fuel injection system as defined by claim 1, wherein said injection valve is provided with means complemental to means formed on said nipple.

4. A fuel injection system as defined by claim 1, wherein each said plug nipple further includes an electric plug whereby an electrical connection to an electric plug terminal of said injection valve can be simultaneously established when said injection valve is inserted into said plug nipple.

5. A fuel injection system as defined in claim 1, wherein said fuel line comprises a spray-molded element.

6. A fuel injection system as defined by claim 1, wherein said fuel line comprises a pressure-cast element.

7. A fuel injection system as defined by claim 1, wherein said fuel line is held on said engine by securing elements.

* * * * *